US009194182B2

(12) United States Patent
Comarmond

(10) Patent No.: US 9,194,182 B2
(45) Date of Patent: Nov. 24, 2015

(54) HYDRAULIC ROTARY PERCUSSIVE DEVICE INTENDED TO DRILL BOREHOLES

(75) Inventor: Jean-Sylvain Comarmond, Vourles (FR)

(73) Assignee: MONTABERT, Saint-Priest (FR)

( * ) Notice: Subject to any disclaimer, the term of this patent is extended or adjusted under 35 U.S.C. 154(b) by 393 days.

(21) Appl. No.: 13/820,669

(22) PCT Filed: Sep. 2, 2011

(86) PCT No.: PCT/FR2011/052008

§ 371 (c)(1),
(2), (4) Date: Mar. 4, 2013

(87) PCT Pub. No.: WO2012/089949

PCT Pub. Date: Jul. 5, 2012

(65) Prior Publication Data

US 2013/0168153 A1 Jul. 4, 2013

(30) Foreign Application Priority Data

Sep. 13, 2010 (FR) ..... 10 57262

(51) Int. Cl.
*E21B 6/00* (2006.01)
*E21B 6/04* (2006.01)

(52) U.S. Cl.
CPC .... *E21B 6/00* (2013.01); *E21B 6/04* (2013.01)

(58) Field of Classification Search
None
See application file for complete search history.

(56) References Cited

U.S. PATENT DOCUMENTS

| | | | | |
|---|---|---|---|---|
| 3,074,381 | A | 1/1963 | Osgood | |
| 3,807,512 | A | 4/1974 | Pogonowski et al. | |
| 3,822,752 | A | 7/1974 | Montabert | |
| 2007/0079697 | A1 * | 4/2007 | Comarmond | 91/276 |
| 2009/0159305 | A1 * | 6/2009 | Comarmond | 173/105 |

FOREIGN PATENT DOCUMENTS

| | | | |
|---|---|---|---|
| FR | 2 902 821 | A1 | 12/2007 |
| GB | 670538 | A | 4/1952 |
| GB | 1 343 857 | A | 1/1974 |

OTHER PUBLICATIONS

International Search Report issued in International Application No. PCT/FR2011/052008 dated Nov. 10, 2011.

* cited by examiner

*Primary Examiner* — Jennifer H Gay
*Assistant Examiner* — Caroline Butcher
(74) *Attorney, Agent, or Firm* — Oliff PLC

(57) ABSTRACT

The rotary percussive device includes a casing forming a support, a striking mechanism equipped with a longitudinal body, rotatably mounted in the casing along the axis of the body, including a cylinder extending along the axis of the body, a striking piston slidingly mounted inside the cylinder and intended to strike a shank coupled to a drill rod, and a distribution device arranged to control an alternating movement of the striking piston along the axis of the body, and a motor arranged to drive the body of the striking mechanism in rotation along an axis of rotation substantially coinciding with the axis of the body. The striking mechanism includes a closing lid mounted on the body and arranged to close one of the ends of the body, the closing lid being coupled in rotation to an output shaft of the motor and at least partially including the distribution device.

13 Claims, 3 Drawing Sheets

HYDRAULIC ROTARY PERCUSSIVE DEVICE INTENDED TO DRILL BOREHOLES

The present invention concerns a hydraulic rotary percussive device of the drill type, intended for drilling boreholes.

Drilling machines are used in various applications, such as drilling quarries, tunnels or mines. These machines are made up of a carrying portion, called carrier, on which a guideway is located, the latter part receiving a rotary percussive device, of the drill type.

A rotary percussive device is generally made up of a striking mechanism and a rotary mechanism. This device, installed on the carrier, then receives hydraulic power and transforms it into mechanical striking and rotational power to make boreholes owing to a shank, a drill rod and a cutting edge in contact with the rock.

The striking mechanism is generally rigidly assembled in the casing of the rotary percussive device while the rotary mechanism comprising a motor mounted laterally on a shaft parallel to that of the striking mechanism, drives in rotation, via reduction pinions, the shank of the drill rod. This shank is therefore animated in rotational movement and receives the shocks, supplied by the piston, of the striking mechanism.

The drawback of this traditional solution lies in the significant cost of the device due to the presence of pinions, which are expenses parts whereof the installation in the device requires costly mechanical devices.

Document FR 2 902 821 describes a rotary percussive device comprising a casing forming a support, and a striking mechanism including a longitudinal body, rotatably mounted in the casing along the axis of the body, comprising a cylinder extending along the axis of the body, a striking piston slidingly mounted inside the cylinder and intended to strike a shank coupled to at least one drill rod, and a distribution device arranged to control an alternating movement of the striking piston along the axis of the body. The rotary percussive device also comprises a motor arranged to drive the mechanical striking body in rotation along an axis of rotation substantially coinciding with the axis of the body.

The distribution device belonging to the rotary percussive device described in document FR 2 902 821 comprises, although not shown in the figures, an annular distributor arranged around the striking piston.

Such a technical solution makes it possible to offset the drawbacks of the traditional solution previously described, but involves, due to the presence of an annular distributor having a large diameter, an increased width of the device and significant pressurized fluid leaks causing a decrease in the device's efficiency.

The technical difficulties of this solution also lie in the fact that in case of rotary operation, i.e. without feeding the striking mechanism, the body of that mechanism can be brought into intense frictional contact on the rear inner wall of the casing of the device.

The present invention aims to resolve all or part of these drawbacks.

The technical problem forming the basis for the invention consists in particular of providing a hydraulic rotary percussive device having a simple, economical and compact structure, and having improved efficiency.

To that end, the present invention concerns a hydraulic rotary percussive device of the drill type, intended to drill boreholes, including:

a casing forming a support, a striking mechanism including a longitudinal body, rotatably mounted in the casing along the axis of the body, comprising a cylinder extending along the axis of the body, a striking piston slidingly mounted inside the cylinder and intended to strike a shank coupled to a drill rod equipped with a tool, and a distribution device arranged to control an alternating movement of the striking piston along the axis of the body, a motor arranged to drive the body of the striking mechanism in rotation along an axis of rotation substantially coinciding with the axis of the body, characterized in that the striking mechanism comprises a closing lid mounted on the body and arranged to close one of the ends of the body, the closing lid being coupled in rotation to an output shaft of the motor and including the distribution device at least in part.

The fact that the closing lid at least partially includes the distribution device makes it possible to obtain a more compact rotary percussive device, and to use a distributor with smaller dimensions, which limits the pressurized fluid leaks and therefore improves the device's efficiency.

Advantageously, the device comprises a high-pressure fluid supply circuit, a low-pressure return circuit, and a pushing chamber defined at least in part by the body and the striking piston and arranged to be alternatingly connected with the supply circuit and the return circuit, under the action of the distribution device.

Preferably, the distribution device includes a distributor and means for controlling the movement of the distributor arranged at least partially in the closing lid.

According to a first embodiment, the distributor is mounted in a first bore formed in the closing lid.

Preferably, the distributor comprises a first control face and a second control face opposite the first face, and the control means includes at least a first control channel emerging on one hand in the cylinder and on the other hand in a first portion of the first bore situated on the side of the first face of the distributor, and a second control channel emerging on one hand in the cylinder and on the other hand in a second portion of the first bore situated on the side of the second face of the distributor, the first and second control channels being formed at least partially in the closing lid and being arranged to steer the distributor as a function of the position of the striking piston in the cylinder.

According to a second embodiment, the distributor comprises a central portion, a first end portion extending parallel to the axis of the distributor and a second end portion antagonistic to the first end portion and extending parallel to the axis of the distributor, the central portion is slidingly mounted in a second bore formed in the body of the striking mechanism, the first end portion is slidingly mounted in a housing formed in the closing lid and emerging in the second bore, and the second end portion is slidingly mounted in a housing formed in the body and emerging in the second bore.

Advantageously, the control means includes a first control chamber defined by the free end of the first end portion and the closing lid, a second control chamber defined by the free end of the second end portion and the body, a first control channel continuously connected to the supply circuit and emerging in the first control chamber, and a second control channel emerging on one hand in the cylinder and on the other hand in the second control chamber, the second control channel being arranged to be alternatingly connected with the supply circuit and the return circuit, depending on the position of the striking piston in the cylinder. Advantageously, the first control channel is formed at least in part in the closing lid.

Preferably, the second end portion has a section larger than that of the first end portion.

According to a third embodiment, the distributor is slidingly mounted in the cylinder and includes a tubular portion whereof the end turned toward the striking piston is covered by a back wall defining, with the striking piston and the body, the pushing chamber.

Advantageously, the control means includes at least a first control chamber defined at least in part by the closing lid and the tubular portion of the distributor, and a first control channel emerging on one hand in the first control chamber and on the other hand in the cylinder, the first control channel being arranged to be alternatingly connected to the supply circuit and the return circuit, depending on the position of the striking piston in the cylinder.

Preferably, the back wall of the distributor has at least one calibrated orifice, which is preferably axial, arranged to connect the pushing chamber and the first control chamber.

Advantageously, the distribution device comprises a pushing portion extending parallel to the axis of the distributor and slidingly mounted in a housing arranged in the closing lid, the pushing portion comprising an end portion and a second end, opposite the first end, arranged to cooperate with the back wall of the distributor, and the control means includes at least a second control chamber defined by the closing lid and the first end of the pushing portion, and a second control channel emerging in the second control chamber and continuously connected to the supply circuit. According to one embodiment, the pushing portion is integral with the distributor and extends from the back wall thereof. According to another embodiment, the pushing portion is not integral with the distributor, and is formed by a piece independent therefrom.

Preferably, the distributor is slidingly mounted in the cylinder between a first so-called close position, in which the tubular portion of the distributor is situated near the closing lid, and preferably bears against the closing lid, and a second so-called distant position, in which the tubular portion of the distributor is situated away from the closing lid, and in that the striking piston is arranged to move the distributor from the second position toward the first position during its backward movement. These arrangements make it possible on one hand to simplify the distribution device, and on the other hand to improve the efficiency of the device since it is no longer necessary to inject oil to actuate the distributor toward its second position.

Preferably, the distribution device comprises at least a first distribution channel emerging on one hand in the cylinder or bore in which the distributor is mounted and on the other hand in a first annular chamber defined by the casing and the body and connected to the supply circuit, and a second distribution channel emerging on one hand in the cylinder or bore in which the distributor is mounted and on the other hand in a second annular chamber defined by the casing and the body and connected to the return circuit, the first and second distribution channels being arranged to be alternatingly connected to the pushing chamber under the action of the distributor. Advantageously, the first and second distribution channels are arranged to be alternatingly connected to the pushing chamber through the distributor.

According to one embodiment, the device comprises rolling means arranged between the closing lid and the casing. Such rolling means make it possible to support the translational stresses caused on the body and avoid any mechanical friction between the closing lid and the casing.

Preferably, the device comprises a shank comprising a first portion rotationally coupled to the body of the striking mechanism and a second portion rotationally coupled to at least one drill rod including a tool intended to be in contact with a rock to be drilled.

The device advantageously comprises a fluid injection circuit arranged to bring an injection fluid from a fluid intake duct to the tool and the rock to be drilled so as to extract, during the drilling, the rock debris from a borehole.

Preferably, the body defines, with the striking piston, a retraction chamber continuously connected to a high-pressure supply source and arranged to return the striking piston to a position away from the shank.

In any event, the invention will be well understood using the description that follows, in reference to the appended diagrammatic drawing illustrating, as non-limiting examples, several embodiments of the hydraulic rotary percussive device.

FIG. 1 shows a hydraulic rotary percussive device 2 of the drill type, intended to drill boreholes.

Figure 1:
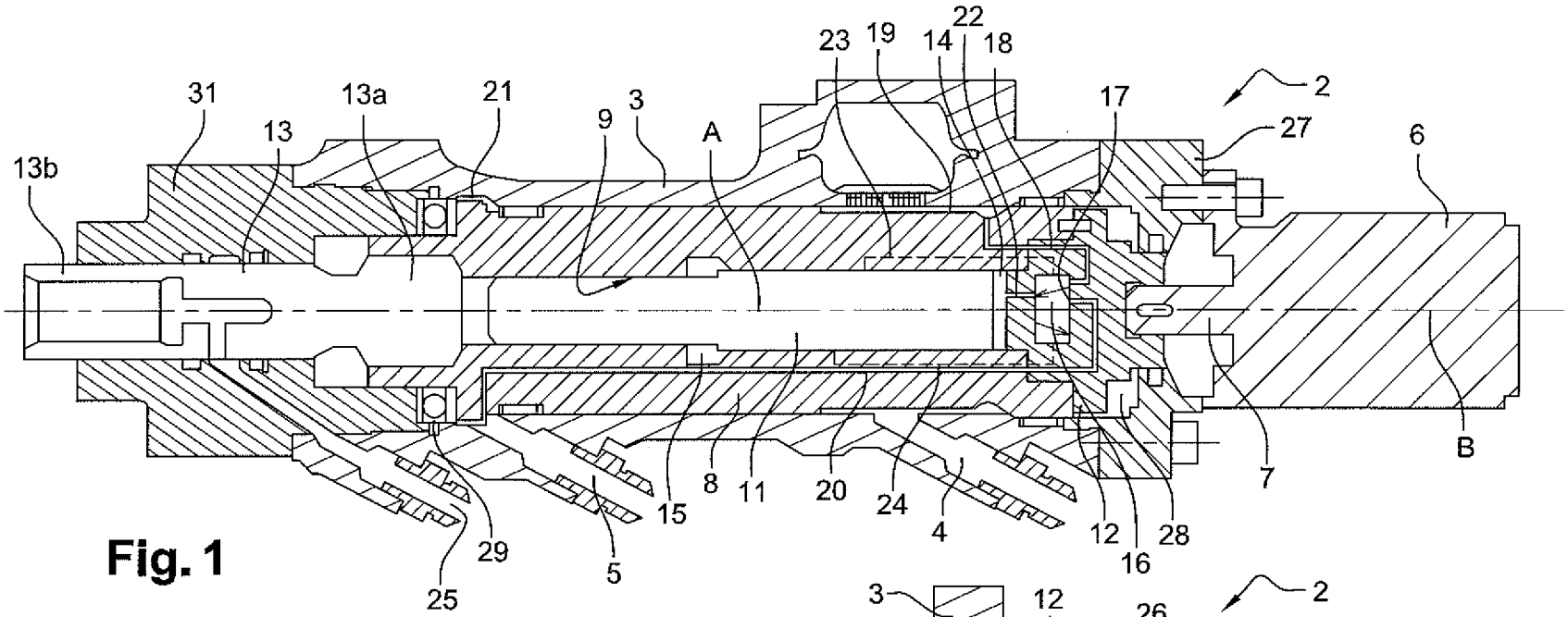
FIG. 1 is a longitudinal cross-sectional view of a rotary percussive device according to a first embodiment of the invention.

The rotary percussive device 2 includes a casing 3 to which are connected a high-pressure fluid supply circuit 4 and a low-pressure return circuit 5. The casing 3 is equipped with a hydraulic motor 6 including an output shaft 7, the hydraulic motor 6 being situated at the back of the device.

The rotary percussive device 2 also includes a striking mechanism comprising a body 8, which is substantially cylindrical, mounted free in rotation in the casing 3 along the axis A of the body and in which a cylinder 9 is formed extending along the axis of the body 8. The striking mechanism also comprises a striking piston 11 slidingly mounted inside the cylinder 9, and a closing lid 12 mounted fixed on the body 8 and arranged to close a first end of the body. The closing lid 12 is coupled in rotation to the output shaft 7 of the hydraulic motor 6. The coupling is done via direct coaxial driving, for example of the ribbed shaft and housing type or the elastic coupling type.

It must be noted that the axis A of the body 8 and the closing lid 12 coincides with the axis of rotation B of the motor 6. Because of this, the hydraulic motor 6 is arranged to drive in rotation, in the casing 3, the body 8 around the axis A thereof.

The rotary percussive device 2 comprises a shank 13 comprising a first portion 13*a* rotatably coupled to the body 8 and a second portion 13*b* intended to be rotatably coupled to at least one drill rod (not shown in the figures) including a tool intended to be in contact with a rock to be drilled.

The rotary percussive device 2 also comprises a pushing chamber 14 defined by the body 8, the striking piston 11 and the closing lid 12, and a retraction chamber 15 subject to the supply pressure of the high-pressure source, and defined by the body 8 and the striking piston 11.

The rotary percussive device 2 also includes a distribution device arranged to control an alternating movement of the striking piston 11 inside the cylinder 9. The distribution device includes a distributor 16 slidingly mounted in a bore 17 formed in the closing lid 12, the distributor 16 comprising a first control face and a second control face opposite the first face.

The distribution device also comprises a first distribution channel 18 emerging on one hand in the bore 17 and on the other hand in a first annular chamber 19 defined by the casing 3 and the body 8 and connected to the supply circuit 4, and a second distribution channel 20 emerging on one hand in the bore 17 and on the other hand in a second annular chamber 21 defined by the casing 3 and the body 8 and connected to the return circuit 5. The first and second distribution channels 18, 20 are formed in part in the closing lid 12 and in part in the body 8, and are arranged to be alternatingly connected to the pushing chamber 14 under the action of the distributor 16 and via a connecting channel 22, formed in the closing lid 12, emerging on one hand in the bore 17 and on the other hand in the pushing chamber 14. Because of this, the pushing chamber 14 is intended to be alternatingly connected to the supply circuit 4 and the return circuit 5.

The alternation of the pressures, high then low, in the pushing chamber 14, causes, in a known manner, the alternating movement of the piston 11 inside the cylinder 9 and the striking of the striking piston 11 on the shank 13.

The distribution device also comprises control means arranged to control the triggering of the movement of the distributor 16. The control means includes a first control channel 23 emerging on one hand in the cylinder 9 and on the other hand in the bore 17 opposite the first face of the distributor 11, and a second control channel 24 emerging on one hand in the cylinder 9 and on the other hand in the bore 17 opposite the second face of the distributor 11. The first and second control channels 23, 24 are formed in part in the closing lid 12 and in the body 8. The first and second control channels 23, 24 are arranged to control the distributor 16 as a function of the position of the striking piston 11 in the cylinder 9, and more particularly to trigger the movement of the distributor 16 either in one direction or in the other direction depending on the position of the striking piston 11 in the cylinder.

Advantageously, the rotary percussive device 2 comprises a fluid injection circuit 25 arranged to convey an injection fluid from a fluid intake duct to the tool and the rock to be drilled so as to extract, during the drilling, the rock debris outside a borehole.

When the striking mechanism of the rotary percussive device 2 illustrated in FIG. 1 is supplied by the supply circuit 4, the volume 28 defined by the lid and the flange is also pressurized, and pushes the assembly formed by the body 8 and the closing lid 12 bearing against a ball thrust bearing 29 arranged between the body 8 and a front guide 31 of the casing. These arrangements make it possible to limit the friction between the body and the lid on one hand and the casing on the other hand.

However, when the striking mechanism is not supplied, the operator can cause a significant pushing of the drill rod on the shank 13, which then pushes the body 8 and the closing lid back against the flange 27, which causes significant friction between the closing lid and the casing that can damage the operation of the rotary percussive device.

Figure 2:
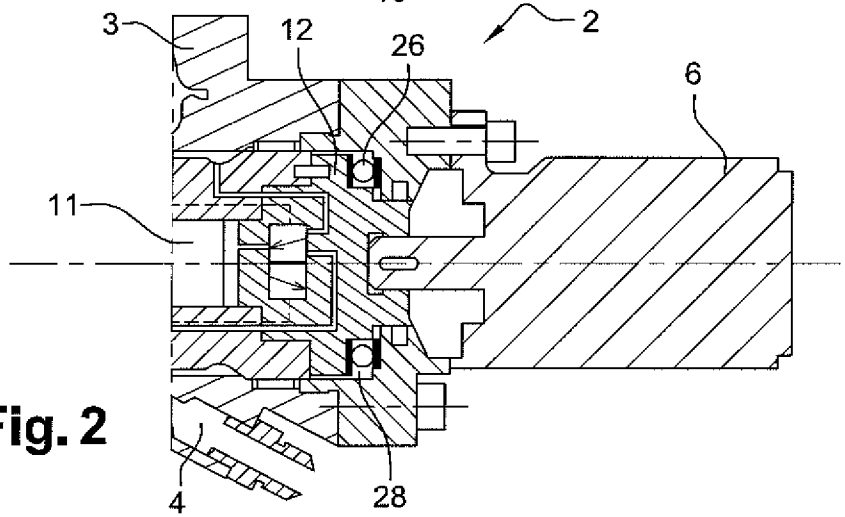
FIG. 2 is a partial longitudinal cross-sectional view of a rotary percussive device according to a second embodiment of the invention.

FIG. 2 shows a rotary percussive device 2 according to a second embodiment that makes it possible to offset this drawback.

According to this second embodiment, the rotary percussive device comprises a ball thrust bearing 26 or thrust roller bearing arranged between the closing lid 12 and the casing 3, and more particularly between the face of the closing lid 12 opposite the striking piston 11 and a rear flange 27 of the casing 3.

The presence of the ball thrust bearing 26 prevents damaging contact between the closing lid 12 and the flange 27 fixed to the casing 3, including when the striking mechanism is not fed.

Figure 3:
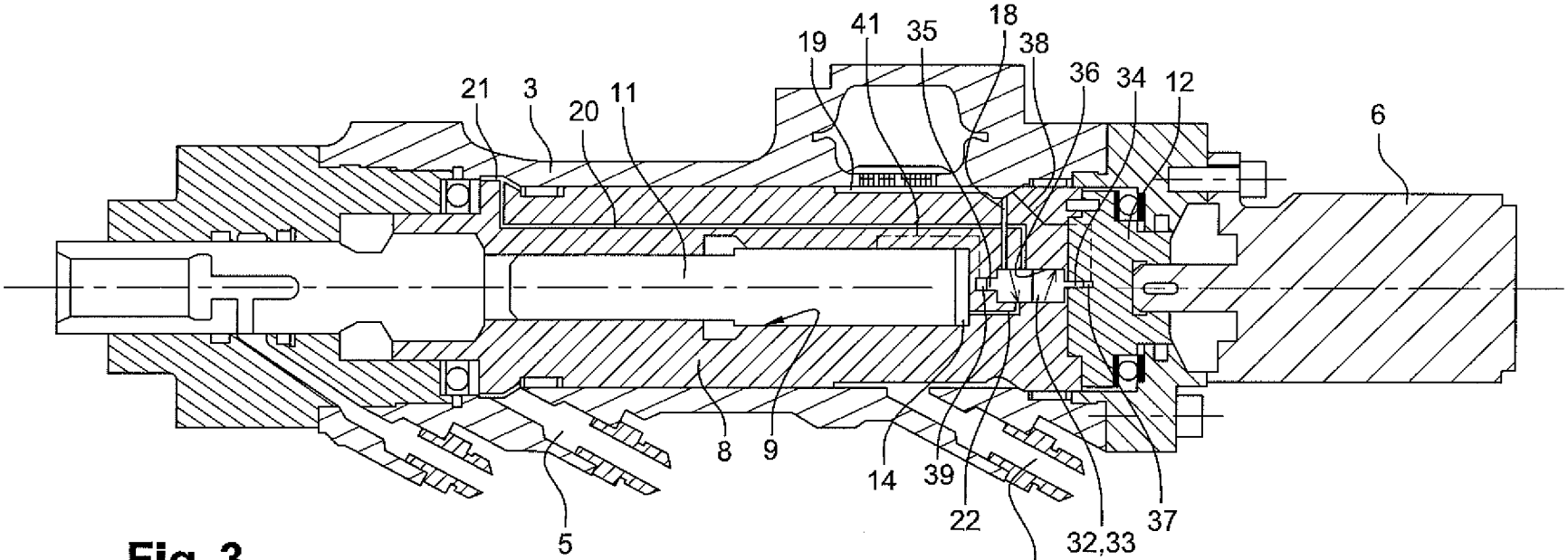
FIG. 3 is a longitudinal cross-sectional view of a rotary percussive device according to a third embodiment of the invention.

FIG. 3 shows a rotary percussive device 2 according to a third embodiment. According to this third embodiment, the distributor 32 comprises a central portion 33, a first end portion 34 extending along the axis of the distributor and having a section smaller than that of the central portion, and a second end portion 35, antagonistic to the first end portion, extending along the axis of the distributor and having a section smaller than that of the central portion 33 and larger than that of the first end portion 34.

The central portion 33 is slidingly mounted in a bore 36 formed in the body 8 of the striking mechanism, while the first end portion 34 is slidingly mounted in a housing having a complementary shape formed in the closing lid 12 and emerging in the bore 36, and the second end portion 35 is slidingly mounted in a housing having a complementary shape formed in the body 8 and emerging in the bore 36.

The control means includes a first control chamber 37 defined by the free end of the first end portion 34 and the closing lid 12, and a first control channel 38 emerging on one hand in the annular chamber 19 continuously connected to the supply circuit and on the other hand in the first control chamber 37. The control means also includes a second control chamber 39 defined by the free end of the second end portion 35 and the body 8, and a second control channel 41 emerging on one hand in the cylinder 9 and on the other hand in the second control chamber 39. The second control channel 41 is arranged to be alternatingly connected with the supply circuit 4 and the return circuit 5, depending on the position of the striking piston 11 in the cylinder 9.

It must be noted that the first and second distribution channels 18, 20, the second control channel 41 and the connecting channel 22 are formed in the body 8, while the first control channel 38 is formed in part in the closing lid 12 and in part in the body 8.

Figure 4:
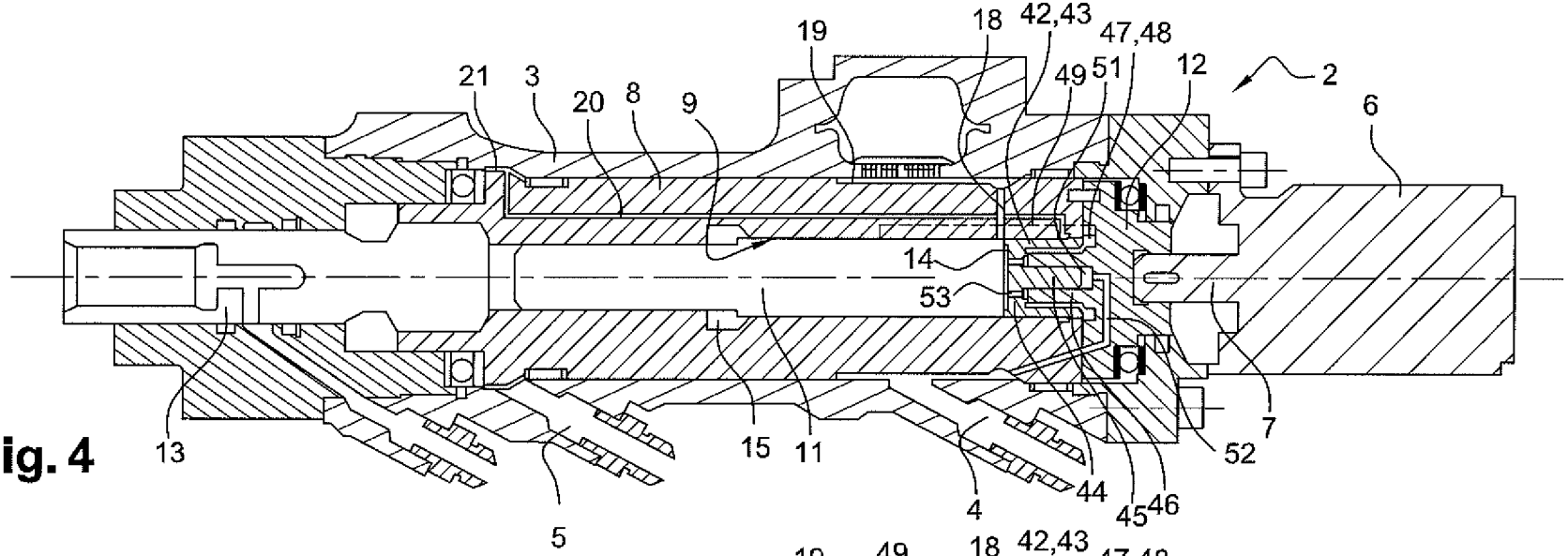
FIGS. 4 and 5 are longitudinal cross-sectional views of a rotary percussive device according to a fourth embodiment of the invention, showing the device in two different operating positions, respectively.
Figure 5:
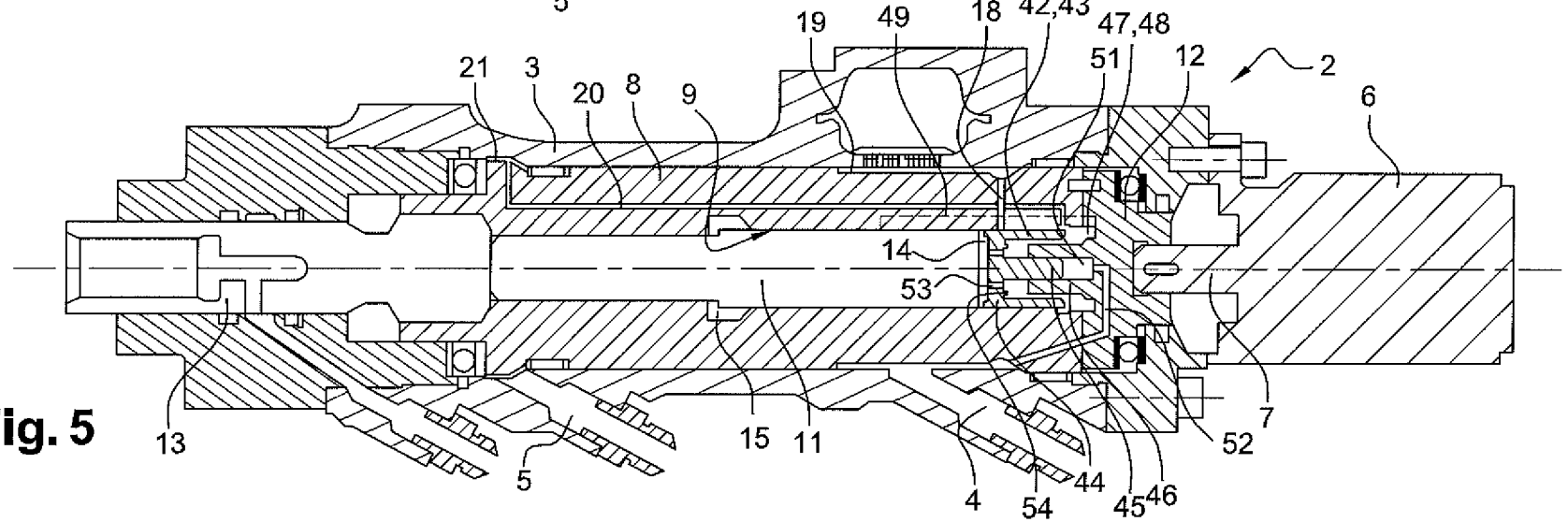

FIGS. 4 and 5 show a rotary percussive device 2 according to a fourth embodiment. According to this fourth embodiment, the distributor 42 is slidingly mounted in the cylinder 9 and includes a tubular portion 43 whereof the end turned toward the striking piston 11 is covered by a back wall 44 defining, with the striking piston 11 and the body 8, the pushing chamber 14.

The distributor 42 also comprises a pushing portion 45 extending from the back wall 44 along the axis of the distributor. The pushing portion 45 is slidingly mounted in a tubular portion 46 protruding from the face of the closing lid 12 turned toward the striking piston 11.

The control means includes a first control chamber 47 defined at least in part by the tubular portion 46 of the closing lid 12, the tubular portion 43 of the distributor 42 and an annular groove 48 formed in the face of the closing lid 12 turned toward the striking piston 11. The control means also includes a first control channel 49 emerging on one hand in the first control chamber 47, and more particularly in the annular groove 48, and on the other hand in the cylinder 9. The first control channel 49 is arranged to be alternatingly connected to the supply circuit 4 and the return circuit 5, depending on the position of the striking piston 11 in the cylinder 9.

The control means also includes a second control chamber 51 defined by the closing lid 12 and the free end of the pushing portion 45, and a second control channel 52, formed partly in the lid 12, emerging on one hand in the second control chamber 51 and on the other hand in the annular chamber 19 continuously connected to the supply circuit 4.

The alternating movement of the distributor 42 is obtained by connecting the first control chamber 47 alternatingly with the supply circuit 4 and the return circuit 5, such that the resulting force applied to the distributor is successively exerted in one direction and then the other.

The back wall 44 of the distributor 42 has a plurality of calibrated orifices 53 emerging on one hand in the pushing chamber 14 and on the other hand in the first control chamber 47, and an annular sealing rib 54 turned toward the tubular portion 46 and arranged to cooperate with the free end thereof so as to prevent the connection of the pushing chamber 14 and the first control chamber 47 through the calibrated orifices 53.

It must be noted that the first and second control channels 49, 52 are formed in part in the closing lid 12 and in part in the body 8, and that the first and second distribution channels 18, 20 emerge in the cylinder 9.

The operation of the device shown in FIGS. 4 and 5 will now be described.

The initial state is that shown in FIG. 4, in which the distributor 42 is in position bearing against the closing lid and the striking piston 11 is in position bearing against the distributor 42. Once the pressurized fluid circulates in the supply circuit 4, the result of the forces applied to the distributor 42 keeps the latter in its position shown in FIG. 4, the first control chamber 47 being connected to the return circuit 5 in particular via the first control channel 49 and the striking piston 11. The result of the forces applied to the striking piston causes the travel of the striking piston 11 on the shank 13, since the pushing chamber 14 is connected to the supply circuit 4 via the first distribution channel 18.

During the striking travel of the striking piston 11, the following operations occur:

When the striking piston 11 has performed a certain portion of its striking travel, the latter establishes a connection between the supply circuit 4 and the first control channel 49.

The first control chamber 47 is then at high pressure, such that the result of the forces applied to the distributor 42 causes a movement thereof in contact with the striking piston 11, as shown in FIG. 5.

In this position of the distributor 42, the latter covers the opening of the first distribution channel 18 in the cylinder 9, and opens the opening of the second distribution channel 20 in the cylinder 9, the pushing chamber 14 then being connected with the return circuit 5 via calibrated orifices 53, of the first control chamber 47 and the second distribution channel 20.

Due to the pressure exerted on the striking piston 11 by the pressurized fluid contained in the chamber 15 and the connection of the pushing chamber 14 with the return circuit 5, the result of the forces applied to the striking piston 11 causes the backward travel of the piston 11. During its backward travel, with it the striking piston 11 drives the distributor 42 until it is in contact with the closing lid 12. The striking piston 11 and the distributor end up in their position shown in FIG. 4, and the following cycle can then begin.

Figure 6:
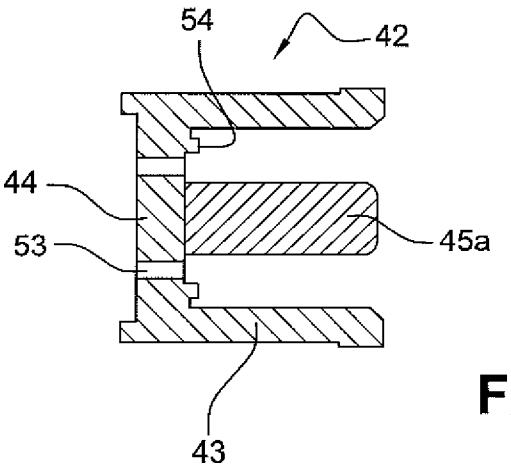
FIG. 6 is a partial longitudinal cross-sectional view, enlarged, of an alternative embodiment of the distribution device illustrated in FIGS. 4 and 5.

FIG. 6 shows a distribution device that differs from the one shown in FIGS. 4 and 5 essentially in that the pushing portion 45*a* is formed by a part independent of the distributor 42, but the movement of which remains integral with that of the distributor 42.

It goes without saying that the invention is not limited to the embodiments of this rotary percussive device described above as examples; on the contrary, it encompasses all alternative embodiments.

The invention claimed is:

1. A hydraulic rotary percussive device of the drilling type, intended to drill boreholes, including:

a casing forming a support, a striking mechanism including a longitudinal body, rotatably mounted in the casing along the axis of the body, comprising a cylinder extending along the axis of the body, a striking piston slidingly mounted inside the cylinder and intended to strike a shank coupled to a drill rod equipped with a tool, and a distribution device arranged to control an alternating movement of the striking piston along the axis of the body, a motor arranged to drive the body of the striking mechanism in rotation along an axis of rotation substantially coinciding with the axis of the body, wherein the striking mechanism comprises a closing lid mounted on the body and arranged to close one of the ends of the body, the closing lid being coupled in rotation to an output shaft of the motor and including the distribution device at least in part, the distribution device includes a distributor mounted in a first bore formed in the closing lid, and a control means for controlling the movement of the distributor, the control means being arranged at least partially in the closing lid.

2. The device according to claim 1, further comprising a high-pressure fluid supply circuit, a low-pressure return circuit, and a pushing chamber defined at least in part by the body and the striking piston and arranged to be alternatingly connected with the supply circuit and the return circuit, under the action of the distribution device.

3. The device according claim 1, wherein the distributor comprises a first control face and a second control face opposite the first face, and the control means includes at least a first control channel emerging in the cylinder and in a first portion of the first bore situated on the side of the first face of the distributor, and a second control channel emerging in the cylinder and in a second portion of the first bore situated on the side of the second face of the distributor, the first and second control channels being formed at least partially in the closing lid and being arranged to steer the distributor as a function of the position of the striking piston in the cylinder.

4. The device according to claim 1, wherein the distributor comprises a central portion, a first end portion extending parallel to the axis of the distributor and a second end portion antagonistic to the first end portion with respect to the central portion and extending parallel to the axis of the distributor, the central portion is slidingly mounted in a second bore formed in the body of the striking mechanism, the first end portion is slidingly mounted in a housing formed in the closing lid and emerging in the second bore, and the second end portion is slidingly mounted in a housing formed in the body and emerging in the second bore.

5. The device according to claim 4, further comprising a high-pressure fluid supply circuit, a low-pressure return circuit, and a pushing chamber defined at least in part by the body and the striking piston and arranged to be alternatingly connected with the supply circuit and the return circuit, under the action of the distribution device; and wherein the control means includes a first control chamber defined by the free end of the first end portion and the closing lid, a second control chamber defined by the free end of the second end portion and the body, a first control channel continuously connected to the supply circuit and emerging in the first control chamber, and a second control channel emerging in the cylinder and in the second control chamber, the second control channel being arranged to be alternatingly connected with the supply circuit and the return circuit, depending on the position of the striking piston in the cylinder.

6. The device according to claim 1, further comprising a high-pressure fluid supply circuit, a low-pressure return circuit, and a pushing chamber defined at least in part by the body and the striking piston and arranged to be alternatingly connected with the supply circuit and the return circuit, under the action of the distribution device; and wherein the distributor is slidingly mounted in the cylinder and includes a tubular portion whereof the end turned toward the striking piston is covered by a back wall defining, with the striking piston and the body, the pushing chamber.

7. The device according to claim 6, wherein the control means includes at least a first control chamber defined at least in part by the closing lid and the tubular portion of the distributor, and a first control channel emerging in the first control chamber and in the cylinder, the first control channel being arranged to be alternatingly connected to the supply circuit and the return circuit, depending on the position of the striking piston in the cylinder.

8. The device according to claim 7, wherein the back wall of the distributor has at least one calibrated orifice, arranged to connect the pushing chamber and the first control chamber.

9. The device according to claim 6, wherein the distribution device comprises a pushing portion extending parallel to the axis of the distributor and slidingly mounted in a housing arranged in the closing lid, the pushing portion comprising an end portion and a second end, opposite the first end, arranged to cooperate with the back wall of the distributor, and the control means includes at least a second control chamber defined by the closing lid and the first end of the pushing portion, and a second control channel emerging in the second control chamber and continuously connected to the supply circuit.

10. The device according to claim 6, wherein the distributor is slidingly mounted in the cylinder between a first position, in which the tubular portion of the distributor is situated near the closing lid, and a second position, in which the tubular portion of the distributor is situated away from the closing lid, and the striking piston is arranged to move the distributor from the second position toward the first position during its backward movement.

11. The device according to claim 1, further comprising a high-pressure fluid supply circuit, a low-pressure return circuit, and a pushing chamber defined at least in part by the body and the striking piston and arranged to be alternatingly connected with the supply circuit and the return circuit, under the action of the distribution device; and wherein the distribution device comprises at least a first distribution channel emerging in the cylinder or bore in which the distributor is mounted and in a first annular chamber defined by the casing and the body and connected to the supply circuit, and a second distribution channel emerging in the cylinder or bore in which the distributor is mounted and in a second annular chamber defined by the casing and the body and connected to the return circuit, the first and second distribution channels being arranged to be alternatingly connected to the pushing chamber under the action of the distributor.

12. The device according to claim 1, further comprising rolling means arranged between the closing lid and the casing.

13. A hydraulic rotary percussive device of the drilling type, intended to drill boreholes, including:

a casing forming a support, a striking mechanism including a longitudinal body, rotatably mounted in the casing along the axis of the body, comprising a cylinder extending along the axis of the body, a striking piston slidingly mounted inside the cylinder and intended to strike a shank coupled to a drill rod equipped with a tool, and a distribution device arranged to control an alternating movement of the striking piston along the axis of the body, a motor arranged to drive the body of the striking mechanism in rotation along an axis of rotation substantially coinciding with the axis of the body, wherein the striking mechanism comprises a closing lid mounted on the body and arranged to close one of the ends of the body, the closing lid being coupled in rotation to an output shaft of the motor and including the distribution device at least in part, the distribution device includes a distributor at least partially slidingly mounted in a housing formed in the closing lid, and a control arrangement configured to control the movement of the distributor and arranged at least partially in the closing lid.

* * * * *